US010127915B2

(12) United States Patent
Bilobrov

(10) Patent No.: US 10,127,915 B2
(45) **Date of Patent: *Nov. 13, 2018**

(54) MANAGING SILENCE IN AUDIO SIGNAL IDENTIFICATION

(71) Applicant: Facebook, Inc., Menlo Park, CA (US)

(72) Inventor: Sergiy Bilobrov, Santa Clara, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/496,634

(22) Filed: Apr. 25, 2017

(65) Prior Publication Data

US 2017/0229133 A1 Aug. 10, 2017

Related U.S. Application Data

(63) Continuation of application No. 13/833,734, filed on Mar. 15, 2013, now Pat. No. 9,679,583.

(51) Int. Cl.

| | |
|---|---|
| ***G10L 19/018*** | (2013.01) |
| ***G10L 25/18*** | (2013.01) |
| ***G10L 25/51*** | (2013.01) |
| ***G10L 25/78*** | (2013.01) |

(52) U.S. Cl.

CPC ..... *G10L 19/018* (2013.01); *G10L 25/18* (2013.01); *G10L 25/51* (2013.01); *G10L 25/78* (2013.01)

(58) Field of Classification Search

None

See application file for complete search history.

(56) References Cited

U.S. PATENT DOCUMENTS

| | | | |
|---|---|---|---|
| 2005/0065976 | A1 | 3/2005 | Holm et al. |
| 2005/0091062 | A1 | 4/2005 | Burges et al. |
| 2006/0143190 | A1 | 6/2006 | Haitsma et al. |
| 2007/0055500 | A1 | 3/2007 | Bilobrov |
| 2008/0256106 | A1 | 10/2008 | Whitman |
| 2011/0289098 | A1 | 11/2011 | Oztaskent et al. |
| 2012/0209612 | A1 | 8/2012 | Bilobrov |
| 2013/0101220 | A1 | 4/2013 | Bosworth et al. |
| 2013/0103810 | A1 | 4/2013 | Papakipos et al. |
| 2013/0321713 | A1 | 12/2013 | Scavo |

(Continued)

OTHER PUBLICATIONS

Dickinson, B. "What the heck is the 'social graph' Facebook keeps talking about?" Business Insider, Mar. 2, 2012, 4 pages.

(Continued)

*Primary Examiner* — Curtis Kuntz
*Assistant Examiner* — Qin Zhu
(74) *Attorney, Agent, or Firm* — Fenwick & West LLP

(57) ABSTRACT

An audio identification system determines whether a portion of a sample of an audio signal includes silence and generates a test audio fingerprint for the audio signal based on the presence of silence. In one embodiment, the audio identification system uses a value indicating silence for a portion of the test audio fingerprint corresponding to the portion of the audio signal that includes silence. When comparing the test audio fingerprint to reference audio fingerprints, the portion of the test audio fingerprint including the value indicating the presence of silence is not used. In another embodiment, the audio identification system replaces the portion including silence with additive audio and generates a test audio fingerprint for comparison based on the resulting modified sample.

20 Claims, 4 Drawing Sheets

(56) References Cited

U.S. PATENT DOCUMENTS

| | | | | |
|---|---|---|---|---|
| 2014/0108441 | A1 | 4/2014 | Samari et al. | |
| 2014/0129571 | A1* | 5/2014 | Scavo | G06F 17/30038 707/748 |

OTHER PUBLICATIONS

Haitsma, J. et al., "A Highly Robust Audio Fingerprinting System," IRCAM, vol. 2002, 9 pages.

Kha Yam, S. A., "The Discrete Cosine Transform (OCT): Theory and Application," Department of Electrical & Computer Engineering, Michigan State University, Mar. 10, 2003, 32 Pages, can be retrieved at <http://www.tach.ula.ve/vermiq/DCT TR802.pdf>.

Pandora, "Music Feed," Date Unknown, one page. [Online] [Retrieved Oct. 18, 2011] Retrieved from the Wayback Machine <http://help.pandora.com/customer/portal/articles/91278-music-feed>.

United States Office Action, U.S. Appl. No. 13/833,734, Jun. 30, 2016, 15 pages.

United States Office Action, U.S. Appl. No. 13/833,734, Feb. 10, 2016, 17 pages.

United States Office Action, U.S. Appl. No. 13/833,734, Sep. 18, 2015, 16 pages.

United States Office Action, U.S. Appl. No. 13/833,734, May 22, 2015, 15 pages.

United States Office Action, U.S. Appl. No. 13/833,734, Jan. 28, 2015, 13 pages.

* cited by examiner

MANAGING SILENCE IN AUDIO SIGNAL IDENTIFICATION

CROSS REFERENCE TO RELATED APPLICATIONS

This application is a continuation of co-pending U.S. application Ser. No. 13/833,734, filed Mar. 15, 2013, which is incorporated by reference in its entirety.

BACKGROUND

This invention generally relates to audio signal identification, and more specifically to managing silence in audio signal identification.

Real-time identification of audio signals is being increasingly used in various applications. For example, many systems use various audio signal identification schemes to identify the name, artist, and/or album of an unknown song. In one class of audio signal identification schemes, a "test" audio fingerprint is generated for an audio signal, where the test audio fingerprint includes characteristic information about the audio signal usable for identifying the audio signal. The characteristic information about the audio signal may be based on acoustical and perceptual properties of the audio signal. To identify the audio signal, the test audio fingerprint generated from the audio signal is compared to a database of reference audio fingerprints.

However, conventional audio signal identification schemes based on audio fingerprinting have a number of technical problems. For example, current schemes using audio fingerprinting do not effectively manage silence in an audio signal. For example, conventional audio identification schemes often match a test audio fingerprint including silence to a reference audio fingerprint that also includes silence even when non-silent portions of the respective audio signals significantly differ. These false positive occur because many conventional audio identification schemes incorrectly determine that the silent portions of the audio signals are indicative of the audio signals being similar. Accordingly, current audio identification schemes often have unacceptably high error rates when identifying audio signals that include silence.

SUMMARY

To identify audio signals, an audio identification system generates one or more test audio fingerprints for one or more audio signals. A test audio fingerprint is generated by identifying a sample or portion of an audio signal. The sample may be comprised of one or more discrete frames each corresponding to different fragments of the audio signal. For example, a sample is comprised of 20 discrete frames each corresponding to 50 ms fragments of the audio signal. In the preceding example, the sample corresponds to a 1 second portion of the audio signal. Based on the sample, a test audio fingerprint is generated and matched to one or more reference audio fingerprints stored by the audio identification system. Each reference audio fingerprint may be associated with identifying and/or other related information. Thus, when a match between the test audio fingerprint and a reference audio fingerprint is identified, the audio signal from which the test audio fingerprint was generated is associated with the identifying and/or other related information corresponding to the matching reference audio fingerprint. For example, an audio signal is associated with name and artist information corresponding to a reference audio fingerprint matching a test audio fingerprint generated from the audio signal.

The audio identification system performs one or more methods to account for silence within a sample of an audio signal during generation of a test audio fingerprint using the sample. In various embodiments, the audio identification system determines whether silence is included in the sample based on an audio characteristic threshold. Portions of the sample that do not meet the audio characteristic threshold are determined to include silence. In one embodiment, the audio identification system represents portions of the sample identified as including silence as a set of zeros or a set of other special values when generating the test audio fingerprint from the sample. When comparing the test audio fingerprint to reference audio fingerprints, portions of the test audio fingerprint including the zeros or other special values are not considered in the comparisons. Hence, portions of the test audio fingerprint that do not include silence are used to compare the test audio fingerprint to reference audio fingerprints.

In another embodiment, the audio identification system generates a modified sample of the audio signal by replacing portions of the sample determined to include silence with additive audio. The additive audio may have audio characteristics that meet or exceed the audio characteristic threshold. In one aspect, the modified sample including the additive audio is used to generate a test audio fingerprint that is compared to one or more reference audio fingerprints. Because the additive audio masks the portions of the sample including silence, the silence is not considered in comparing the test audio fingerprint to one or more reference audio fingerprints. In one specific implementation of the embodiment, when comparing the test audio fingerprint to the reference audio fingerprints, portions of the test audio fingerprint generated from portions of the audio signal including the additive audio are ignored. Hence, comparisons between the test audio fingerprint and reference audio fingerprints are made using portions of the test audio fingerprint that do not include silence, in the implementation.

The features and advantages described in this summary and the following detailed description are not all-inclusive. Many additional features and advantages will be apparent to one of ordinary skill in the art in view of the drawings, specification, and claims hereof.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Overview

Embodiments of the invention enable the accurate identification of audio signals using audio fingerprints by managing silence within the audio signals. In particular, silence within an obtained audio signal is identified based on the audio signal having audio characteristics below a threshold audio characteristic level. In one embodiment, a test audio fingerprint for the audio signal is generated, where portions of the audio signal identified as silence are represented by zeros or some other special values in the audio fingerprint. When comparing the generated test audio fingerprint to a set of reference audio fingerprints to identify the audio signal, those portions of the test audio fingerprint corresponding to the zeros or some other special values are not used or ignored in the comparison. Because silence is not considered, false positives due to matching of the portions of the test audio fingerprint corresponding to silence and the portions of a reference fingerprint corresponding to silence can be avoided. In another embodiment, the obtained audio signal is modified by replacing the identified silence with additive or test audio. The additive audio includes audio characteristics meeting the threshold audio characteristic level. A test audio fingerprint is then generated using the modified audio signal. The test audio fingerprint is subsequently used to identify the audio signal by comparing the test audio fingerprint to a set of reference audio fingerprints. In one aspect, because silence in the audio signal is masked, the generated test audio fingerprint does not include portions corresponding to silence. Thus, false positives due to matching of the portions of the test audio fingerprint corresponding to silence and the portions of a reference fingerprint corresponding to silence can be avoided. In one implementation of the embodiment, portions of the test audio fingerprint corresponding to the additive audio are additionally not used or ignored in the matching.

Example of Managing Silence in an Audio Identification System

Figure 1:
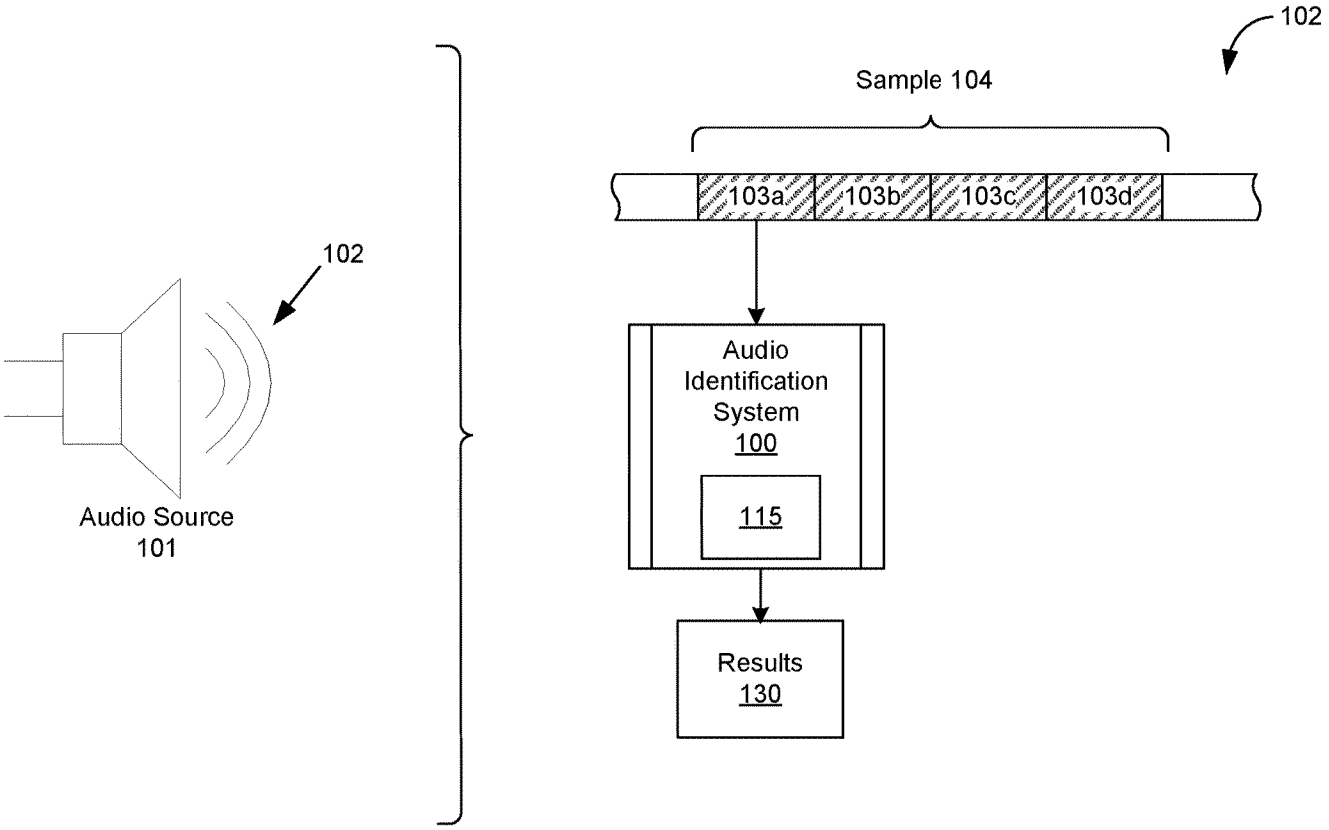
FIG. 1 is a block diagram illustrating a process for identifying audio signals, in accordance with embodiments of the invention.

FIG. 1 shows an example embodiment of an audio identification system 100 identifying an audio signal 102. As shown in FIG. 1, an audio source 101 generates an audio signal 102. The audio source 101 may be any entity suitable for generating audio (or a representation of audio), such as a person, an animal, speakers of a mobile device, a desktop computer transmitting a data representation of a song, or other suitable entity generating audio.

As shown in FIG. 1, the audio identification system 100 receives one or more discrete frames 103 of the audio signal 102. Each frame 103 may correspond to a fragment of the audio signal 102 at a particular time. For example, the frame 103*a* corresponds to a portion of the audio signal 102 between times $t_0$ and $t_1$. The frame 103*b* corresponds to a portion of the audio signal 102 between times $t_1$ and $t_2$. Hence, each frame 103 corresponds to a length of time of the audio signal 102, such as 25 ms, 50 ms, 100 ms, 200 ms, etc. Upon receiving the one or more frames 103, the audio identification system 100 generates a test audio fingerprint 115 for the audio signal 102 using a sample 104 including one or more of the frames 103. The test audio fingerprint 115 may include characteristic information describing the audio signal 102. Such characteristic information may indicate acoustical and/or perceptual properties of the audio signal 102.

The audio identification system 100 matches the generated test audio fingerprint 115 against a set of candidate reference audio fingerprints. To match the test audio fingerprint 115 to a candidate reference audio fingerprint, a similarity score between the candidate reference audio fingerprint and the test audio fingerprint 115 is computed. The similarity score measures the similarity of the audio characteristics of a candidate reference audio fingerprint and the test audio fingerprint 115. In one embodiment, the test audio fingerprint 115 is determined to match a candidate reference audio fingerprint if a corresponding similarity score meets or exceeds a similarity threshold.

When a candidate reference audio fingerprint matches the test audio fingerprint 115, the audio identification system 100 retrieves identifying and/or other related information associated with the matching candidate reference audio fingerprint. For example, the audio identification system 110 retrieves artist, album, and title information associated with the matching candidate reference audio fingerprint. The retrieved identifying and/or other related information may be associated with the audio signal 102 and included in a set of search results 130 or other data for the audio signal 102.

In certain embodiments, the audio identification system 100 identifies and manages silence within the audio signal 102 to improve the accuracy of matching the test audio fingerprint 115 to candidate reference audio fingerprints. For example, the audio identification system 100 determines whether the sample 104 of the audio signal 102 includes audio having characteristics below a threshold audio characteristic level. A sample 104 including characteristics below the threshold audio characteristic level is determined to include silence.

In one embodiment, the audio identification system 100 inserts zero values, or other special values denoting silence in portions of the test audio fingerprint 115 corresponding to portions of silence in the sample 104. When comparing the generated test audio fingerprint 115 with reference audio fingerprints, the audio identification system 100 discards the portions of the test audio fingerprint 115 including the values denoting silence. Hence, portions of the test audio fingerprint 115 corresponding to silence are not considered when matching the test audio fingerprint 115 to reference audio fingerprints.

Alternatively, the audio identification system 100 replaces portions of the sample including silence with additive audio before generating the test audio fingerprint 115. The additive audio may have audio characteristics exceeding the threshold audio characteristic level used to identify silence. This allows the audio identification system 100 to avoid incorrectly matching two audio fingerprints because each audio fingerprint includes silence. In some embodiments, the additive audio may additionally have certain audio characteristics that minimize the additive audio's impact on matching a corresponding test audio fingerprint to reference audio fingerprints. As a result, the audio identification system 100 can avoid incorrectly determining that two fingerprints do not match due to one including additive audio. After inserting the additive audio in the audio signal 102, the modified sample is used to generate the test audio fingerprint 115 for the audio signal 102. The test audio fingerprint 115 is then compared to the reference audio fingerprints to identify one or more matching reference audio fingerprints. In one embodiment, portions of the test audio fingerprint 115 corresponding to the additive audio are not used when matching the test audio fingerprint 115 to reference audio fingerprints.

Accounting for silence in a sample of the audio signal 102 allows the audio identification system 100 to more accurately compare the test audio fingerprint 115 of the audio signal 102 to reference audio fingerprints. By masking silence and/or disabling matching for portions of a test audio fingerprint 115 corresponding to silence, the audio identification system 100 avoids incorrectly matching the test audio fingerprint 115 to a reference audio fingerprint because both fingerprints include silence. Rather, audio fingerprint matches are based primarily on portions of the test audio fingerprint 115 and reference audio fingerprints that do not correspond to silence. This reduces the error rate in audio signal 102 identification based on the test audio fingerprint 115.

System Architecture

Figure 2A:
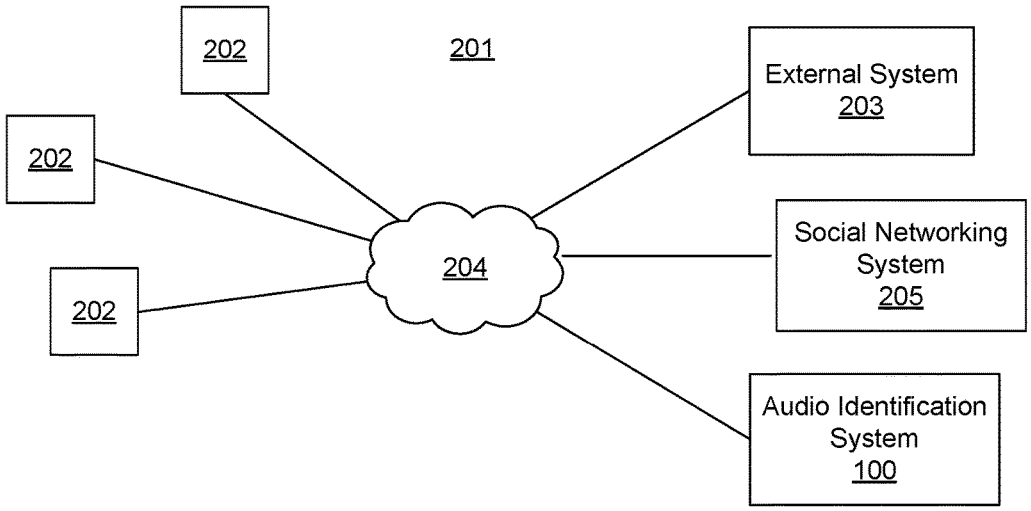
FIG. 2A is a block diagram illustrating a system environment including an audio identification system, in accordance with embodiments of the invention.

FIG. 2A is a block diagram illustrating one embodiment of a system environment 201 including an audio identification system 100. As shown in FIG. 2A, the system environment 201 includes one or more client devices 202, one or more external systems 203, the audio identification system 100, a social networking system 205, and a network 204. While FIG. 2A shows three client devices 202, one social networking system 205, and one external system 203, it should be appreciated that any number of these entities (including millions) may be included. In alternative configurations, different and/or additional entities may also be included in the system environment 201.

A client device 202 is a computing device capable of receiving user input, as well as transmitting and/or receiving data via the network 204. In one embodiment, a client device 202 sends requests to the audio identification system 100 to identify an audio signal captured or otherwise obtained by the client device 202. The client device 202 may additionally provide the audio signal or a digital representation of the audio signal to the audio identification system 100. Examples of client devices 202 include desktop computers, laptop computers, tablet computers (pads), mobile phones, personal digital assistants (PDAs), gaming devices, or any other device including computing functionality and data communication capabilities. Hence, the client devices 202 enable users to access the audio identification system 100, the social networking system 205, and/or one or more external systems 203. In one embodiment, the client devices 202 also allow various users to communicate with one another via the social networking system 205.

The network 204 may be any wired or wireless local area network (LAN) and/or wide area network (WAN), such as an intranet, an extranet, or the Internet. The network 204 provides communication capabilities between one or more client devices 202, the audio identification system 100, the social networking system 205, and/or one or more external systems 203. In various embodiments the network 204 uses standard communication technologies and/or protocols. Examples of technologies used by the network 204 include Ethernet, 802.11, 3G, 4G, 802.16, or any other suitable communication technology. The network 204 may use wireless, wired, or a combination of wireless and wired communication technologies. Examples of protocols used by the network 204 include transmission control protocol/Internet protocol (TCP/IP), hypertext transport protocol (HTTP), simple mail transfer protocol (SMTP), file transfer protocol (TCP), or any other suitable communication protocol.

The external system 203 is coupled to the network 204 to communicate with the audio identification system 100, the social networking system 205, and/or with one or more client devices 202. The external system 203 provides content and/or other information to one or more client devices 202, the social networking system 205, and/or to the audio identification system 100. Examples of content and/or other information provided by the external system 203 include identifying information associated with reference audio fingerprints, content (e.g., audio, video, etc.) associated with identifying information, or other suitable information.

The social networking system 205 is coupled to the network 204 to communicate with the audio identification system 100, the external system 203, and/or with one or more client devices 202. The social networking system 205 is a computing system allowing its users to communicate, or to otherwise interact, with each other and to access content. The social networking system 205 additionally permits users to establish connections (e.g., friendship type relationships, follower type relationships, etc.) between one another.

In one embodiment, the social networking system 205 stores user accounts describing its users. User profiles are associated with the user accounts and include information describing the users, such as demographic data (e.g., gender information), biographic data (e.g., interest information), etc. Using information in the user profiles, connections between users, and any other suitable information, the social networking system 205 maintains a social graph of nodes interconnected by edges. Each node in the social graph represents an object associated with the social networking system 205 that may act on and/or be acted upon by another object associated with the social networking system 205. Examples of objects represented by nodes include users, non-person entities, content items, groups, events, locations, messages, concepts, and any other suitable information. An edge between two nodes in the social graph represents a particular kind of connection between the two nodes. For example, an edge corresponds to an action performed by an object represented by a node on another object represented by another node. For example, an edge may indicate that a particular user of the social networking system 205 is currently "listening" to a certain song. In one embodiment, the social networking system 205 may use edges to generate stories describing actions performed by users, which are communicated to one or more additional users connected to the users through the social networking system 205. For example, the social networking system 205 may present a story that a user is listening to a song to additional users connected to the user.

Figure 2B:
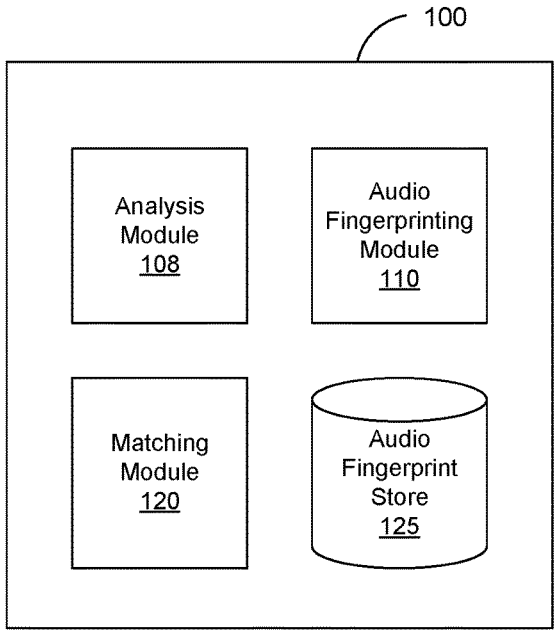
FIG. 2B is a block diagram of an audio identification system, in accordance with embodiments of the invention.

The audio identification system 100, further described below in conjunction with FIG. 2B, is a computing system configured to identify audio signals. FIG. 2B is a block diagram of one embodiment of the audio identification system 100. In the embodiment shown by FIG. 2B, the audio identification system includes an analysis module 108, an audio fingerprinting module 110, a matching module 120, and an audio fingerprint store 125.

The audio fingerprint store 125 stores one or more reference audio fingerprints, which are audio fingerprints previously generated from one or more reference audio signals by the audio identification system 100 or by another suitable entity. Each reference audio fingerprint in the audio fingerprint store 125 is also associated with identifying information and/or other information related to the audio signal from which the reference audio fingerprint was generated. The identifying information may be any data suitable for identifying an audio signal. For example, the identifying information associated with a reference audio fingerprint includes title, artist, album, publisher information for the corresponding audio signal. As another example, identifying information may include data indicating the source of an audio signal corresponding to a reference audio fingerprint. As specific examples, the identifying information may indicate that the source of a reference audio signal is a particular type of automobile or may indicate the location from which the reference audio signal corresponding to a reference audio fingerprint was broadcast. For example, the reference audio signal of an audio-based advertisement may be broadcast from a specific geographic location, so a reference audio fingerprint corresponding to the reference audio signal is associated with an identifier indicating the geographic location (e.g., a location name, global positioning system coordinates, etc.).

In one embodiment, the audio fingerprint store 125 associates an index with each reference audio fingerprint. Each index may be computed from a portion of the corresponding reference audio fingerprint. For example, a set of bits from a reference audio fingerprint corresponding to low frequency coefficients in the reference audio fingerprint may be used may be used as the reference audio fingerprint's index.

The analysis module 108 performs analysis on audio signals and/or modifies the audio signals based on the analysis. In one embodiment, the analysis module 108 identifies silence within a sample of an audio signal. In one embodiment, if silence within a sample is identified, the analysis module 108 replaces the identified silence with additive audio. In another embodiment, if silence within a sample is identified, the analysis module 108 indicates to the fingerprinting module 110 to use zero values or some other special value to represent the silence in a fingerprint generated using the sample.

The fingerprinting module 110 generates fingerprints for audio signals. The fingerprinting module 110 may generate a fingerprint for an audio signal using any suitable fingerprinting algorithm. In one embodiment, the fingerprint module 110, in generating a test fingerprint, uses a set of zero values or some other special value to represent silence within a sample of an audio signal.

The matching module 120 matches test fingerprints for audio signals to reference fingerprints in order to identify the audio signals. In particular, the matching module 120 accesses the fingerprint store 125 to identify one or more candidate reference fingerprints suitable for comparison to a generated test fingerprint for an audio signal. The matching module 120 additionally compares the identified candidate reference fingerprints to the generated test fingerprint for the audio signal. In performing the comparisons, the matching module 120 does not use portions of the generated test fingerprint that include zero values or some other special values. For candidate reference fingerprints that match the generated test fingerprint, the matching module 120 retrieves identifying information associated with the candidate reference fingerprints from the fingerprint store 125, the external systems 203, the social networking system 205, and/or any other suitable entity. The identifying information may be used to identify the audio signal from which the test fingerprint was generated.

In other embodiments, any of the described functionalities of the audio identification system 100 may be performed by the client devices 102, the external system 203, the social networking system 205, and/or any other suitable entity. For example, the client devices 102 may be configured to determine a suitable length for a sample for fingerprinting, generate a test fingerprint usable for identifying an audio signal, and/or determine identifying information for an audio signal. In some embodiments, the social networking system 205 and/or the external system 203 may include the audio identification system 100.

Figure 3:
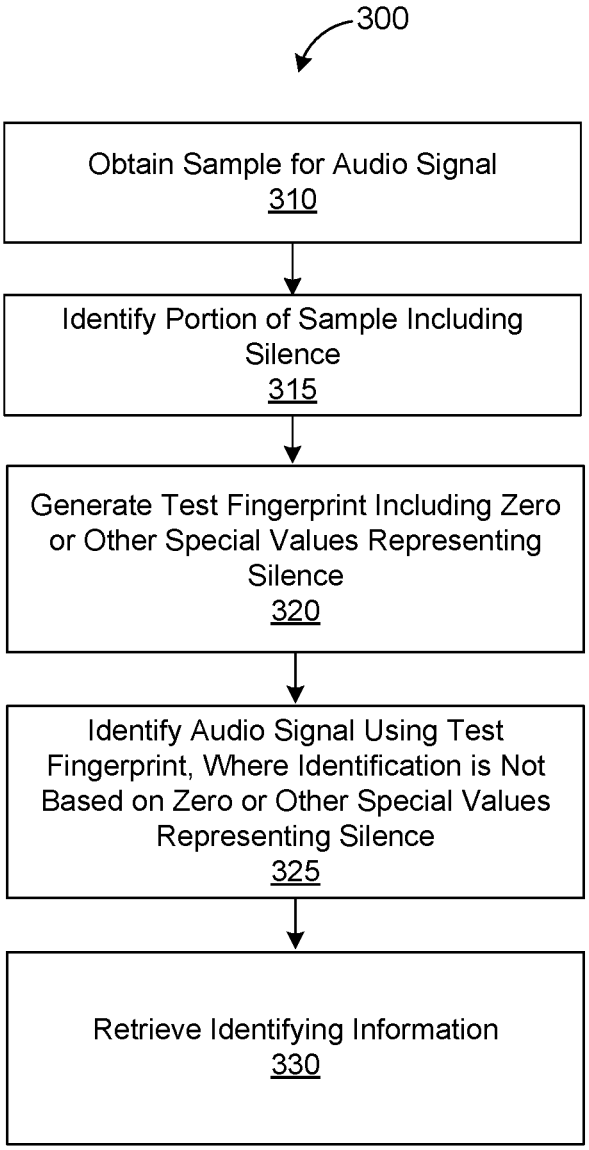
FIG. 3 is a flow chart of a process for managing silence in audio signal identification, in accordance with an embodiment of the invention.

Managing Silence in Audio Signal Identification Based on Values Representative of Silence FIG. 3 illustrates a flow chart of one embodiment of a process 300 for managing silence in audio signal identification. Other embodiments may perform the steps of the process 300 in different orders and may include different, additional and/or fewer steps. The process 300 may be performed by any suitable entity, such as the analysis module 108, the audio fingerprinting module 110, or the matching module 120.

A sample 104 corresponding to a portion of an audio signal 102 is obtained 310. The sample 104 may include one or more frames 103, each corresponding to portions of the audio signal 102. In one embodiment, the audio identification system 100 receives the sample 104 during an audio signal identification procedure initiated automatically or initiated responsive to a request from a client device 202. The sample 104 may also be obtained from any suitable source. For example, the sample 104 may be streamed from a client device 202 of a user via the network 204. As another example, the sample 104 may be retrieved from an external system 203 via the network 204. In one aspect, the sample 104 corresponds to a portion of the audio signal 102 having a specified length, such as a 50 ms portion of the audio signal.

After obtaining the sample 104, the analysis module 108 identifies 315 one or more portions of the sample 104 including silence using any suitable method. In one embodiment, the analysis module 108 identifies 315 a portion of the sample 104 as including silence if audio characteristics of the portion do not exceed an audio characteristic threshold. For example, the analysis module 108 identifies 315 a portion of the sample 104 as including silence if the portion has an amplitude that does not exceed an amplitude threshold. As another example, the analysis module 108 identifies 315 a portion of the sample 104 as including silence if the portion has less than a threshold power. Portions of the sample 104 identified 315 as including silence are indicated by the analysis module 108 by being associated with a marker, flag, or other distinguishing information.

After identifying portions of the sample 104 including silence, the audio fingerprinting module 110 generates 320 a test audio fingerprint 115 based on the sample 104. To generate the test audio fingerprint 115, the audio fingerprinting module 110 converts each frame 103 in the sample 104 from the time domain to the frequency domain and computes a power spectrum for each frame 103 over a range of frequencies, such as 250 to 2250 Hz. The power spectrum for each frame 103 in the sample 104 is split into a number of frequency bands within the range. For example, the power spectrum of a frame is split into 16 different bands within the frequency range of 250 and 2250 Hz. To split a frame's power spectrum into multiple frequency bands, the audio fingerprinting module 110 applies a number of band-pass filters to the power spectrum. Each band-pass filter isolates a fragment of the audio signal 102 corresponding to the frame 103 for a particular frequency band. By applying the band-pass filters, multiple sub-band samples corresponding to different frequency bands are generated.

The audio fingerprinting module 110 resamples each sub-band sample to produce a corresponding resample sequence. Any suitable type of resampling may be performed to generate a resample sequence. Example types of resampling include logarithmic resampling, scale resampling, or offset resampling. In one embodiment, each resample sequence of each frame 103 is stored by the audio fingerprinting module 110 as a [M×T] matrix, which corresponds to a sampled spectrogram having a time axis and a frequency axis for a particular frequency band.

A transformation is performed on the generated spectrograms for the frequency bands. In one embodiment, the audio fingerprinting module 110 applies a two-dimensional Discrete Cosine Transform (2D DCT) to the spectrograms. To perform the transform, the audio fingerprinting module 110 normalizes the spectrogram for each frequency band of each frame 103 and performs a one-dimensional DCT along the time axis of each normalized spectrogram. Subsequently, the audio fingerprinting module 110 performs a one-dimensional DCT along the frequency axis of each normalized spectrogram.

Application of the 2D DCT generates a set of feature vectors for the frequency bands of each frame 103 in the sample 104. Based on the feature vectors for each frame 103, the audio fingerprinting module 110 generates 320 a test audio fingerprint 115 for the audio signal 102. In one embodiment, in generating 320 the test audio fingerprint 115, the fingerprinting module 110 quantizes the feature vectors for each frame 103 to produce a set of coefficients that each have one of a value of −1, 0, or 1.

In one embodiment, portions of the test audio fingerprint 115 corresponding to portions of the sample 104 identified as including silence are replaced by a set or zeros or by other suitable special values. As further discussed below, portions of the audio test fingerprint 115 including the zero values or other special values indicate to the matching module 102 that the identified portions are not used when comparing the test audio fingerprint 115 to reference audio fingerprints. Because portions of the test audio fingerprint 115 corresponding to silence are not used to identify matching reference audio fingerprints, decreasing the likelihood of a false positive from the comparison.

Using the generated test audio fingerprint 115, the matching module 120 identifies 325 the audio signal 102 by comparing the test audio fingerprint 115 to one or more reference audio fingerprints. For example, the matching module 120 matches the test audio fingerprint 115 with the indices for the reference audio fingerprints stored in the audio fingerprint store 125. Reference audio fingerprints having an index matching the test audio fingerprint 115 are identified as candidate reference audio fingerprints. The test fingerprint 115 is then compared to one or more of the candidate reference audio fingerprints. In one embodiment, a similarity score between the test audio fingerprint 115 and various candidate reference audio fingerprints is computed. For example, a similarity score between the test audio fingerprint 115 and each candidate reference audio fingerprint is computed. In one embodiment, the similarity score may be a bit error rate (BER) computed for the test audio fingerprint 115 and a candidate reference audio fingerprint. The BER between two audio fingerprints is the percentage of their corresponding bits that do not match. For unrelated completely random fingerprints, the BER would be expected to be 50%. In one embodiment, two fingerprints are determined to be matching if the BER is less than approximately 35%; however, other threshold values may be specified. Based on the similarity scores, matches between the test audio fingerprint 115 and the candidate reference audio fingerprints are identified.

In one embodiment, the matching module 120 does not use or excludes portions of the test audio fingerprint 115 including zeros or another value denoting silence when computing the similarity scores for the test audio fingerprint 115 and the candidate reference audio fingerprints. In one embodiment, the candidate reference audio fingerprints may also include zeroes or another value denoting silence. In such an embodiment, the portions of the candidate reference audio fingerprints including values denoting silence are also not used or excluded when computing the similarity scores. Hence, the matching module 120 computes similarity scores for the test audio fingerprint 115 and candidate reference audio fingerprints based on portions of the test audio fingerprint 115 and/or the candidate reference audio fingerprints that do not include values denoting silence. This reduces the effect of silence in causing identification of matches between the test audio fingerprint 115 and the candidate reference audio fingerprints.

The matching module 120 retrieves 330 identifying information associated with one or more candidate reference audio fingerprints matching the test audio fingerprint 115. The identifying information may be retrieved 330 from the audio fingerprint store 125, one or more external systems 203, the social networking system 205, and/or any other suitable entity. The identifying information may be included in results provided by the matching module 115. For example, the identifying information is included in results sent to a client device 202 that initially requested identification of the audio signal 102. The identifying information allows a user of the client device 202 to determine information related to the audio signal 102. For example, the identifying information indicates that the audio signal 102 is produced by a particular animal or indicates that the audio signal 102 is a song with a particular title, artist, or other information.

In one embodiment, the matching module 115 provides the identifying information to the social networking system 205 via the network 204. The matching module 115 may additionally provide an identifier for determining a user associated with the client device 202 from which a request to identify the audio signal 102 was received. For example, the identifier provided to the social networking system 205 indicates a user profile of the user maintained by the social networking system 205. The social networking system 205 may update the user's user profile to indicate that the user is currently listening to a song identified by the identifying information. In one embodiment, the social networking system 205 may communicate the identifying information to one or more additional users connected to the user over the social networking system 205. For example, additional users connected to the user requesting identification of the audio signal 102 may receive content identifying the user and indicating the identifying information for the audio signal 102. The social networking system 205 may communicate the content to the additional users via a story that is included in a newsfeed associated with each of the additional users.

Managing Silence in Audio Signal Identification Based on Additive Audio

Figure 4:
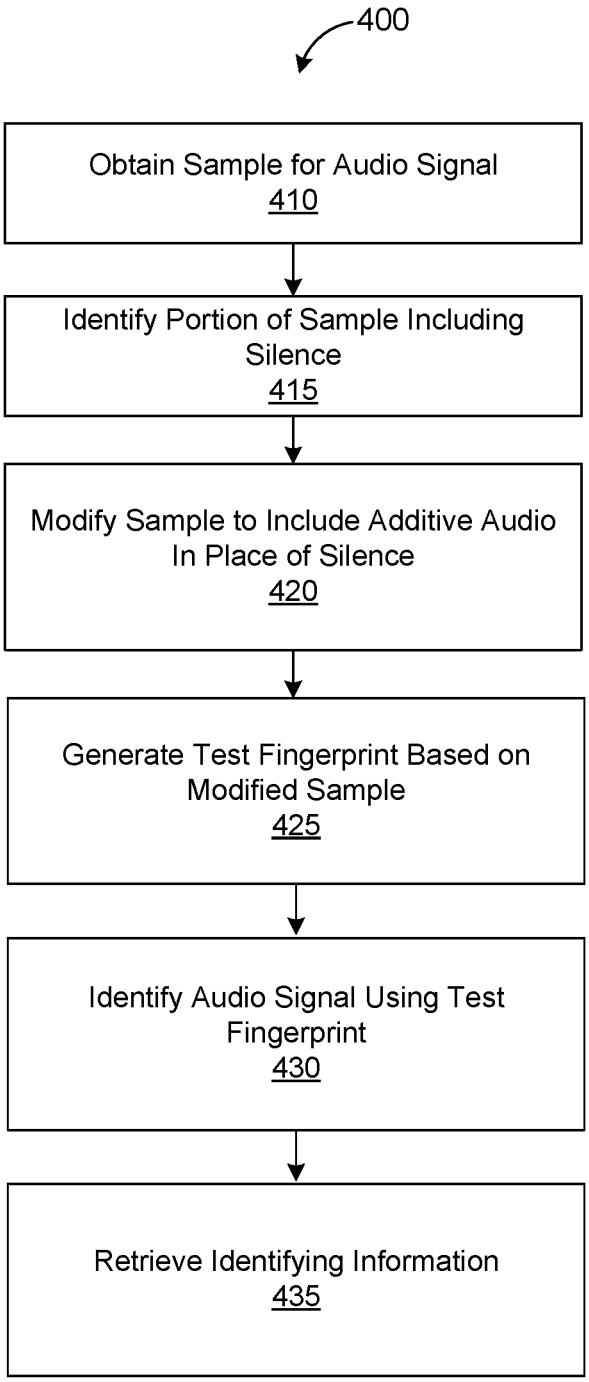
FIG. 4 is a flow chart of an alternative process for managing silence in audio signal identification, in accordance with an embodiment of the invention.

FIG. 4 illustrates a flow chart of one embodiment of another process 400 for managing silence in audio signal identification. Other embodiments may perform the steps of the process 400 in different orders and can include different, additional and/or fewer steps. The process 400 may be performed by any suitable entity, such as the analysis module 108, the audio fingerprinting module 110, and the matching module 120.

A sample 104 corresponding to a portion of an audio signal 102 is obtained 410, and portions of the sample 104 including silence are identified 415. As described above in conjunction with FIG. 3, portions of the sample 104 including silence may be identified 415 using any suitable method. For example, a portion of the sample 104 is identified 415 as including silence if the portion of the sample 104 includes audio characteristics (e.g., amplitude, power, etc.) that do not meet a particular audio characteristic threshold.

The sample 104 is modified 420 to alter the portions of the sample identified as including silence and to generate a modified sample. For example, the analysis module 108 replaces the portions of the sample 104 including silence with additive audio. The additive audio may have audio characteristics that meet or exceed the audio characteristic threshold, so the additive audio masks the silence in the identified portions of the sample 104. By masking silence with the additive audio, the audio identification system 100 reduces the likelihood of false positives due to incorrect matching of the silent portions of a resulting audio test fingerprint 115 to the silent portions of a reference audio fingerprint.

In one embodiment, the additive audio may include audio characteristics that minimize its effect on matching. For example, the additive audio has characteristics that prevent the additive audio from significantly altering matching of the test audio fingerprint with a reference audio fingerprint. This reduces the likelihood of false negatives by incorrectly determining two fingerprints do not match based on one fingerprint including additive audio. In one embodiment, to minimize the effect of the additive audio on matching, an analysis of perceptual and/or acoustical characteristics of the sample 104 may be performed. Based on the analysis, a suitable additive audio may be selected. In one embodiment, the additive audio has characteristics that match psychoacoustic properties of the human auditory system, such as spectral masking, temporal masking and absolute threshold of hearing.

Using the modified sample, the audio fingerprinting module 110 generates 425 a test audio fingerprint 115. Generation of the test audio fingerprint 115 may be performed similarly to the generation of the test audio fingerprint 115 discussed above in conjunction with FIG. 3. The generated test audio fingerprint 115 is used by the matching module 120 to identify 430 the audio signal 102. For example, the matching module 120 accesses the audio fingerprint store 125 to identify a set of candidate reference audio fingerprints, which may be identified based on indices for the reference audio fingerprints. The candidate reference audio fingerprints may have been previously generated from a set of reference audio signals. In one embodiment, portions of the reference audio signals including silence may have also been replaced with additive audio before generating the corresponding candidate reference audio fingerprints. Thus, silence in the candidate reference audio fingerprints may also be masked.

The test audio fingerprint 115 is compared to one or more of the candidate reference audio fingerprints to identify matches between the candidate reference audio fingerprints and the test audio fingerprint 115. Comparison of the test audio fingerprint 115 to the candidate reference audio fingerprints may be performed in a manner similar to that described above in conjunction with FIG. 3. In one embodiment, because silence included in the test audio fingerprint 115 and/or in the candidate reference audio fingerprints have been masked by additive audio, incorrect matching of the test audio fingerprint 115 to a candidate reference audio fingerprint because of silence in the fingerprints is reduced.

Alternatively, in one embodiment, the matching module 120 identifies portions of the test audio fingerprint 115 and/or of the candidate reference audio fingerprints corresponding to additive audio, and does not consider the portions including additive audio when matching the test audio fingerprint 115 to the candidate reference audio fingerprints. For example, a similarity score between the test audio fingerprint 115 and a candidate reference audio fingerprint does not account for portions of the fingerprints including additive audio. Hence, the similarity score is calculated based on portions of the test audio fingerprint 115 and/or the candidate reference audio fingerprint that do not include additive audio.

After the comparisons, the matching module 120 retrieves 435 identifying information associated with one or more candidate reference audio fingerprints matching the test audio fingerprint 115. The retrieved identifying information may be used in a variety of ways. As described above in conjunction with FIG. 3, the retrieved identifying information may be presented to a user via a client device 202 or may be communicated to the social networking system 205 and distributed to social networking system users.

Summary

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. It will be appreciated that the embodiments described herein may be combined in any suitable manner.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may include a general-purpose computing device selectively activated or reconfigured by a computer program stored in the computer. Such a computer program may be stored in a tangible computer readable storage medium or any type of media suitable for storing electronic instructions, and coupled to a computer system bus. Furthermore, any computing systems referred to in the specification may include a single processor or may be architectures employing multiple processor designs for increased computing capability.

Embodiments of the invention may also relate to a computer data signal embodied in a carrier wave, where the computer data signal includes any embodiment of a computer program product or other data combination described herein. The computer data signal is a product that is presented in a tangible medium or carrier wave and modulated or otherwise encoded in the carrier wave, which is tangible, and transmitted according to any suitable transmission method.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A computer-implemented method comprising:

receiving a sample of an audio signal;

determining that at least one portion of the sample includes an audio characteristic representing silence;

generating a modified sample from the sample that includes first additive audio in the at least one portion of the sample including silence, where the first additive audio is above an audio characteristic threshold;

generating a test audio fingerprint based on the modified sample that includes the first additive audio;

comparing the test audio fingerprint with each of a set of candidate reference audio fingerprints previously generated from one or more reference audio signals;

determining that the test audio fingerprint generated based on the first additive audio does not match a first candidate reference audio fingerprint of the set of the candidate reference audio fingerprints;

determining that the test audio fingerprint does match a second candidate reference audio fingerprint of the set of the candidate reference audio fingerprints; and storing an association between information associated with the sample of the audio signal and information associated with the second candidate reference audio fingerprint.

2. The computer-implemented method of claim 1, further comprising:

retrieving identifying information associated with the second candidate reference audio fingerprint based on the comparison between the test audio fingerprint and the second candidate reference audio fingerprint;

generating a story based on a user associated with the sample of the audio signal and the identifying information; and providing the generated story to one or more additional users connected to the user.

3. The computer-implemented method of claim 2, wherein the identifying information indicates a geographic location associated with the second candidate reference audio fingerprint.

4. The computer-implemented method of claim 1, further comprising:

analyzing perceptual characteristics of the sample of the audio signal; and selecting the first additive audio based on the analysis.

5. A computer-implemented method comprising:

receiving a sample of an audio signal;

generating a test audio fingerprint based on the sample;

comparing the test audio fingerprint with each of a set of candidate reference audio fingerprints previously generated from one or more reference audio signals, where a first candidate reference audio fingerprint of the set of candidate reference audio fingerprints was generated from a portion of the one or more reference audio signals that includes an audio characteristic representing silence and to which first additive audio was added, the first additive audio being above an audio characteristic threshold;

determining that the test audio fingerprint does not match the first candidate reference audio fingerprint generated based on the first additive audio;

determining that the test audio fingerprint does match a second candidate reference audio fingerprint of the set of candidate reference audio fingerprints; and storing an association between information associated with the sample of the audio signal and information associated with the second candidate reference audio fingerprint.

6. The computer-implemented method of claim 5, further comprising:

retrieving identifying information associated with the second candidate reference audio fingerprint based on the comparison between the test audio fingerprint and the second candidate reference audio fingerprint;

generating a story based on a user associated with the sample of the audio signal and the identifying information; and providing the generated story to the one or more additional users connected to the user.

7. The computer-implemented method of claim 6, wherein the identifying information indicates a geographic location associated with the second candidate reference audio fingerprint.

8. The computer-implemented method of claim 5, further comprising:

analyzing perceptual characteristics of the sample of the audio signal; and selecting the first additive audio based on the analysis.

9. A computer-implemented method comprising:

receiving a sample of an audio signal;

determining that at least one portion of the sample includes an audio characteristic representing silence;

generating a modified sample from the sample that includes first additive audio in the at least one portion of the sample including silence, where the first additive audio is above an audio characteristic threshold;

generating a test audio fingerprint based on the modified sample that includes the first additive audio;

comparing the test audio fingerprint with each of a set of candidate reference audio fingerprints previously generated from one or more reference audio signals, where a first candidate reference audio fingerprint of the set of candidate reference audio fingerprints was generated from a portion of the one or more reference audio signals that includes an audio characteristic representing silence and to which second additive audio was added, the second additive audio being above an audio characteristic threshold;

determining that the test audio fingerprint generated based on the first additive audio does not match the first candidate reference audio fingerprint generated based on the second additive audio;

determining that the test audio fingerprint does match a second candidate reference audio fingerprint of the set of candidate reference audio fingerprints; and storing an association between information associated with the sample of the audio signal and information associated with the second candidate reference audio fingerprint.

10. The computer-implemented method of claim 9, wherein generating the test audio fingerprint comprises applying a two-dimensional discrete cosine transform (2D DCT) to the sample.

11. The computer-implemented method of claim 9, further comprising:

retrieving identifying information associated with the second candidate reference audio fingerprint based on the comparison between the test audio fingerprint and the second candidate reference audio fingerprint.

12. The computer-implemented method of claim 11, wherein the identifying information indicates a geographic location associated with the second candidate reference audio fingerprint.

13. The computer-implemented method of claim 11, further comprising:

describing a user associated with the sample of the audio signal and the identifying information to one or more additional users of the online system connected to the user.

14. The computer-implemented method of claim 13, wherein describing the user and the identifying information comprises:

generating a story based on the user and the identifying information; and providing the generated story to the one or more additional users connected to the user.

15. The computer-implemented method of claim 14, wherein the generated story is included in a newsfeed presented to at least one of the one or more additional users.

16. The computer-implemented method of claim 9, further comprising:

identifying one or more audio characteristics of the received sample of the audio signal, wherein an audio characteristic is selected from a group consisting of:

an amplitude characteristic, a power characteristic, and a combination thereof.

17. The computer-implemented method of claim 9, further comprising:

computing a bit error rate between the test audio fingerprint and each candidate reference audio fingerprint of the set of candidate reference audio fingerprints, the bit error rate between the test audio fingerprint and the candidate reference audio fingerprint representing a measurement of corresponding bits of the test audio fingerprint and the candidate reference audio fingerprint that do not match; and in response to the bit error rate between the test audio fingerprint and the candidate reference audio fingerprint being below a threshold value:

identifying the candidate audio fingerprint as a matching candidate audio fingerprint; and retrieving identifying information associated with the identified candidate audio fingerprint.

18. The computer-implemented method of claim 17, wherein the measurement of the corresponding bits of the test audio fingerprint and the candidate reference audio fingerprint that do not match comprises a percentage of the corresponding bits of the test audio fingerprint and the candidate reference audio fingerprint that do not match.

19. The computer-implemented method of claim 18, wherein a reference audio fingerprint has an index and the index of the reference audio fingerprint is computed from a set of bits from the reference audio fingerprint, the set of bits from the reference audio fingerprint corresponding to a plurality of low frequency coefficients in the reference audio fingerprint.

20. The computer-implemented method of claim 9, further comprising:

analyzing perceptual characteristics of the sample of the audio signal; and selecting the first additive audio based on the analysis.

* * * * *